United States Patent [19]

Beery

[11] 4,249,676

[45] Feb. 10, 1981

[54] AIR VENT CHECK VALVE

[75] Inventor: Floyd T. Beery, Prairie Village, Kans.

[73] Assignee: Hallmark Cards Incorporated, Kansas City, Mo.

[21] Appl. No.: 44,347

[22] Filed: May 31, 1979

[51] Int. Cl.[3] ..... B05B 11/00

[52] U.S. Cl. ..... 222/321; 222/383; 222/481

[58] Field of Search ..... 222/321, 383, 481

[56] References Cited

U.S. PATENT DOCUMENTS

| | | | |
|---|---|---|---|
| 4,057,176 | 11/1977 | Horvath | 222/383 X |
| 4,065,038 | 12/1977 | Magers et al. | 222/321 |
| 4,201,317 | 5/1980 | Aleff | 222/383 X |

*Primary Examiner*—Robert J. Spar
*Assistant Examiner*—Frederick R. Handren
*Attorney, Agent, or Firm*—Schmidt, Johnson, Hovey & Williams

[57] ABSTRACT

An improved, plunger-type hand pump for liquids in flexible containers is provided which includes a check valve for preventing outward flow of liquid through the air intake passageway of the pump, as a consequence of simultaneous depression of the pump plunger and incidental deformation of the flexible container walls. The pump includes a skirted head mounted atop the plunger and an upstanding, cooperating, skirt-receiving collar, and an annular vent opening forming a part of the air intake passageway of the pump is presented between the skirt and collar. The check valve preferably comprises a flexible annular washer mounted on the pump head for reciprocation therewith, and the outer periphery of the washer slidingly engages the collar to seal the container opening against outflow of liquid.

3 Claims, 5 Drawing Figures

AIR VENT CHECK VALVE

BACKGROUND OF THE INVENTION

1. Field of the Invention

The present invention is concerned with an improved manual pump assembly especially adapted for use with molded flexible containers. More particularly, it is concerned with such an improved pump which includes check valve means strategically located so as to prevent inadvertent outflow of liquid from the container during the pumping sequence, as can occur when a user depresses the pump plunger and incidentally deforms the flexible sidewalls of the container.

2. Description of the Prior Art

Hand pumps of the reciprocal type are of course well known. Generally speaking, such pumps include an elongated, axially reciprocal, tubular plunger, and means responsive to reciprocation of the plunger for withdrawing and dispensing a charge of liquid from a container. In addition, such manual pumps normally provide structure which defines an air inlet passageway such that after a charge of liquid is withdrawn from the container, a corresponding volume of air is drawn into the same.

U.S. Pat. Nos. 3,531,224 and 4,065,038 relate to pump assemblies of the general nature discussed above. Although not limited to pumps of the type disclosed in the mentioned patents, the present invention will be described in connection therewith; accordingly, the disclosures of both of these patents are incorporated by reference herein.

Although pump assemblies of the type described in U.S. Pat. Nos. 3,531,224 and 4,065,038 are in widespread use, problems arise when it is attempted to use such pumps in conjunction with molded flexible containers. That is to say, there is a natural tendency on the part of users of sprayable materials in hand pump-equipped bottles to simultaneously depress the pump plunger and exert inwardly directed pressure against the sidewalls of the container. When a rigid container is employed this obviously presents no problems. However, if the container is a molded flexible unit, such hand pressure can deform the sidewalls of the container, thereby displacing the liquid therein toward the upper end of the container. In the case of pump sprayers of the type discussed above, vent openings are provided (which form a part of the air intake passageways for the pump) which are located such that hand pressure-induced displacement of the liquid within the container can cause such liquid to pass outwardly through the vent opening and onto the hands of the user. As can be appreciated, this is an objectionable result, particularly when an expensive, allergenic or toxic liquid product is within the container.

Accordingly, there is a real need in the art for an improved hand pump assembly which is usable in the normal manner with flexible containers but which is modified to prevent inadvertent liquid spillage incident to normal pumping operations.

SUMMARY OF THE INVENTION

The present invention overcomes the problems noted above by provision of a strategically located check valve means disposed within the air intake passageway for the pump. The check valve means serves two purposes, i.e., to permit intake air from the atmosphere to the interior of the container as needed, and to prevent outflow of liquid from the container through the air intake passageway of the pump.

In preferred forms of the present invention the pump includes a head mounted on the outermost end of the plunger and has a normally depending skirt. The skirt is telescoped within a stationary, upstanding collar wall mounted on the container, such that a continuous, annular vent opening is defined between the skirt and wall. This vent forms a part of the overall air intake passageway for the pump.

The preferred check valve means comprises a flexible member disposed proximal to the annular vent opening for the purposes described. Preferably, the check valve means is in the form of an annular washer disposed about the plunger for engaging the underside of the skirt and the inner surface of the circumscribing wall portion, so as to present a piston-like seal; upon depression of the head and plunger, air trapped beneath the washer is directed through the portions of the air intake passageway therebelow, so as to prevent outflow of liquid.

DESCRIPTION OF THE PREFERRED EMBODIMENT

1. The Known Pump

Figure 2:
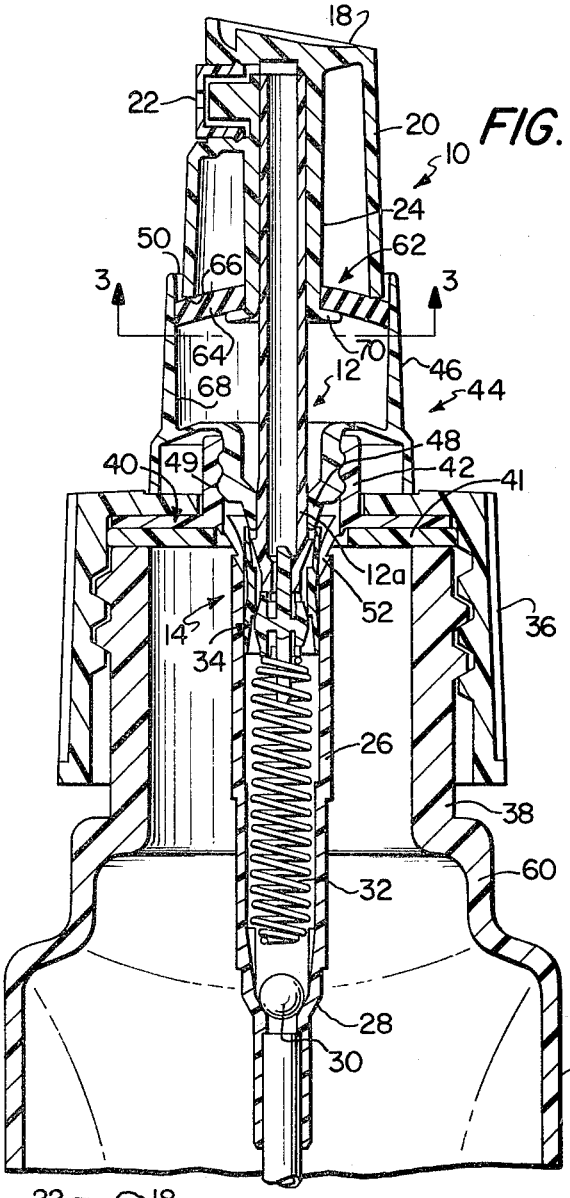
FIG. 2 is an enlarged, fragmentary vertical sectional view illustrating the construction of the pump assembly.

In its particular aspects, the present invention is concerned with improved versions of known hand pumps, and especially the pumps described in U.S. Pat. Nos. 3,531,224 and 4,065,038. Accordingly, all of the details of the construction and operation of the known pumps need not be fully described, except insofar as necessary to understand the improvement of the present invention. This is especially the case in view of the incorporation by reference of the disclosures of the above-mentioned patents.

Nevertheless, it will be understood that (see FIGS. 2 and 5) a pump 10 in accordance with the invention broadly includes an elongated, axially reciprocal, tubular, fluid-conveying plunger 12, and means referred to by the numeral 14 which is responsive to reciprocation of plunger 12 for withdrawing a charge of liquid from a container 16 holding the same. In addition, structure is provided which defines an air intake passageway for communicating the interior of container 16 and the atmosphere.

In more detail, the pump 10 includes a depression head 18 mounted atop the tubular plunger 12, the head 18 being provided with a depending skirt 20. Head 18 is apertured to accommodate a liquid spray discharge outlet 22 which is in operative communication with the interior of the tubular plunger 12. It will also be noted that the head 18 is telescoped over the upper end of plunger 12, and that internal mounting sleeve 24 is provided for this purpose.

The pump 10 further includes an elongated, tubular, plunger-receiving body 26 adapted to be disposed within container 16. The body 26 is configured to present a lower valve ball seat 28, and has therein a shiftable valve ball 30, helical spring 32, and plunger-actuated operating mechanism 34 which is engaged by the spring 32.

Knurled cap 36 is threadably mounted upon the neck 38 of container 16, and serves to retain a flanged element 40 and a seal 41. The element 40 includes an upstanding, central tubular portion 42 and a peripheral flange as depicted.

A collar member 44 is positioned atop cap 36 and includes an upstanding, enclosed tubular wall portion 46, and a depending, irregularly shaped, plunger engaging annulus 48. The tubular portion 42 and the upper end of annulus 48 are frictionally coupled by means of complemental, interlocked, annular undulating regions 49 on each of the latter. The lower region of annulus 48, in the rest position of pump 10 depicted in FIG. 2, engages a radially expanded zone 12*a* on the plunger 12.

The air intake passageway for pump 10 is defined as follows. First, as best seen in FIG. 2, an annular air intake vent 50 is provided between the telescopically interfitted skirt 20 and the upstanding tubular wall portion 46. Additionally, downward shifting of plunger 12 causes the lower plunger-engaging region of annulus 48 to clear the zone 12*a* and thus creates an opening between the region and the portion of plunger 12 above zone 12*a*. This will be readily appreciated from a study of the drawing. Finally, a pair of internal vent openings 52 are provided through the circular sidewall of body 26 below the plunger-engaging region of annulus 48.

During pumping operations, head 18 and plunger 12 are manually depressed in the usual manner. As fully described in U.S. Pat. No. 4,065,038, this in turn opens flow passages provided in the operating mechanism 34 and pumps liquid from container 16 through the body 26, plunger 12 and outlet 22.

When the head 18 is released, spring 32 serves to shift the operating mechanism and plunger back to its original FIG. 2 position. During this return movement, air is drawn into the interior of container 16. That is to say, air is drawn through the annular intake vent opening 50, the annular space between annulus 48 and the restricted diameter portion of the plunger 12 above zone 12*a*, and the vent openings 52. As can be appreciated, such intake air is necessary to the operation of a hand pump of the type herein described.

2. The Improvement

The known pump described above has been improved and is made suitable for use with flexibile liquid containers by provision of flexible check valve means broadly referred to by the numeral 62, which is operatively disposed proximal to the annular vent opening 50. The check valve means is operative for preventing outward flow of liquid through the air intake passageway and vent opening 50, and also allows flow of air past the check valve means as needed during the pumping cycle.

More particularly, check valve means 62 preferably comprises an annular resilient washer 64 which is mounted about sleeve 24 and plunger 12 and simultaneously engages the underside 66 of skirt 20 and the inner surface 68 of the wall portion 46. In this way an effective, continuous, moving seal is provided below the annular vent opening 50. Washer 66 is mounted on the sleeve 24 for reciprocation with the head 18. To this end, sleeve 24 is provided with a lowermost, integral, continuous flange 70 which supports the yieldable washer 64. The washer is further held in place by the friction fit which results from selecting a washer 64 having a bore diameter slightly less than the outside diameter of sleeve 24. This also serves to dispose the washer 64 in a slightly downturned orientation as illustrated in the drawing.

Figure 4:
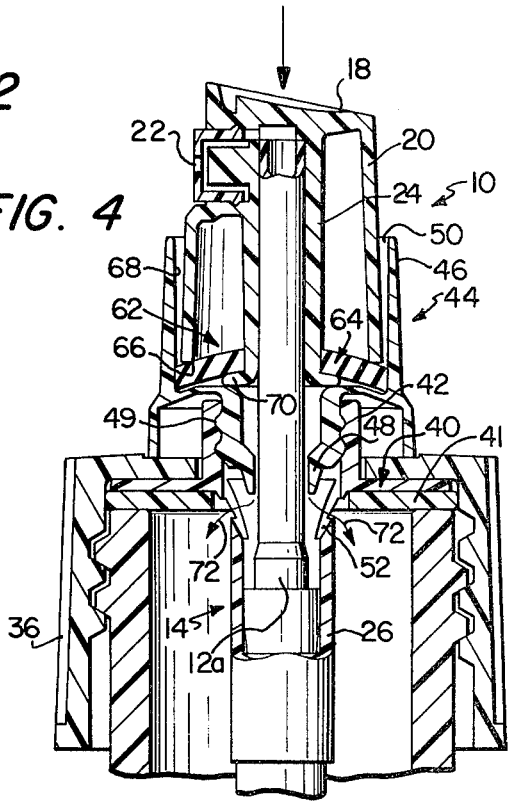
FIG. 4 is a fragmentary sectional view with parts broken away for clarity which illustrates the pumping operation of the improved pump of the invention.
Figure 1:
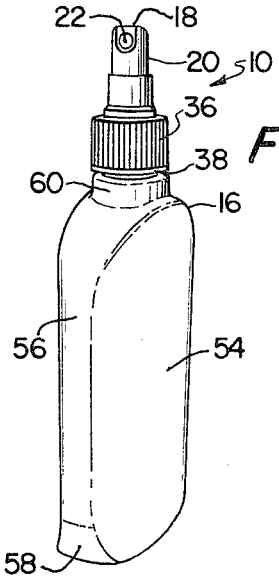
FIG. 1 is a perspective view of the pump assembly of the present invention, mounted in a flexible container.
Figure 3:
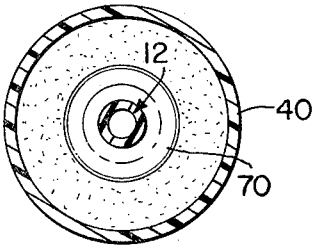
FIG. 3 is a sectional view taken along line 3—3 of FIG. 2.
Figure 5:
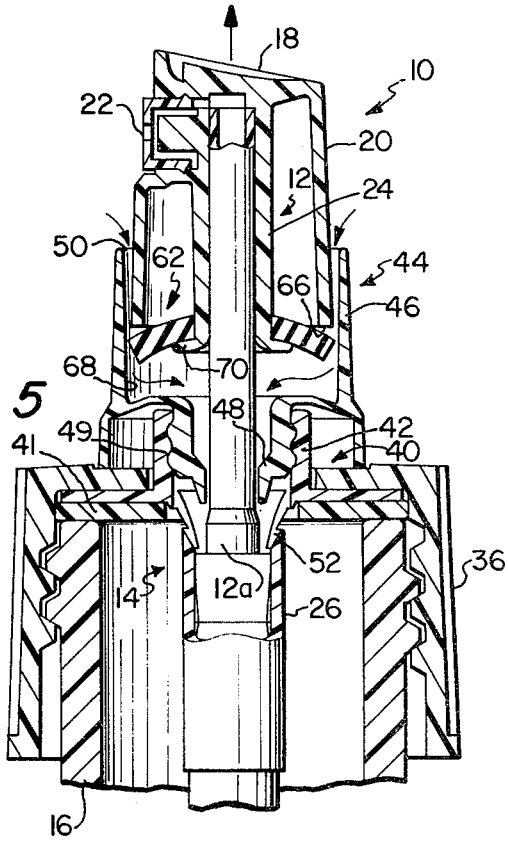
FIG. 5 is a view similar to that of FIG. 4 but illustrates the pump of the invention during the air intake cycle.

The operation of the improved pump of the invention is best illustrated in FIGS. 4 and 5. FIG. 4 depicts the fluid-drawing operation of the pump when head 18 is depressed. That is to say, manual depression of the head 18 serves to shift the head and associated plunger downwardly within body 26. As described in U.S. Pat. No. 4,065,038, this opens flow passages within operating mechanism 34 and pumps a charge of liquid upwardly through body 26, plunger 12 and discharge outlet 22. During this mode of operation, it may occur that the user will simultaneously depress the head 18 and also inwardly deform the sidewall 54 of flexible container 16. As noted, if this occurs it is important to prevent outward flow of liquid within the container through the air intake passageway of the pump. The check valve means 62 accomplishes this in the following manner. As the head 18 is shifted downwardly, a piston-like effect is obtained between the outer periphery of the washer 64 and the wall surface 68. This serves to force the air trapped beneath the washer 64 through the lower portion of the air intake passageway, i.e., through the annular opening created between the lower plunger-engaging region of annulus 48 and plunger 12, and the vents 52. This action is illustrated by the arrows 72. This forced movement of air serves to effectively prevent an upflow of fluid from container 16 through the vents 52 and out of container 16 through the air intake passageway of the pump. Of course, a secondary, physical seal is provided because of the sealing engagement between the washer 64 and the wall surface 68, in the event that some fluid does reach this level.

When the plunger is released, spring 32 serves to move the head and plunger upwardly as illustrated in FIG. 5. In this mode of operation it is important that atmospheric air be allowed to pass into container 16. This is accomplished in the usual fashion, and the washer 64 does not present an obstacle to such flow. Specifically, during this cycle, the flexible washer 64 is forced by air pressure slightly away from engagement with the wall surface 68, thus opening the air intake passageway. Air can thus be drawn into container 16 in the normal manner.

Although a wide variety of flexible washers can be employed in the present invention, it has been found that washers formed of appropriate urethane, silicone rubbers, buna-type synthetic rubbers, neoprenes or chlorinated or fluorinated rubbers can be used to good effect. Moreover, the selected material should have a Shore A durometer of up to about 90, more preferably about 50. In practice, a selected washer having a bore diameter of 3/16 inch has been used to good effect with a sleeve having an outside diameter of $\frac{1}{4}$ inch.

Having thus described the invention, what is claimed as new and desired to be secured by Letters Patent is:

1. In a hand pump adapted for pumping a liquid from a flexible container, said pump including an elongated, axially reciprocal plunger, a head mounted on the outermost end of said plunger having a normally depending skirt extending along the length of said plunger, a stationary collar including a normally upwardly extending enclosed wall portion, said wall portion being configured to telescopically receive said skirt upon depression of said plunger, with a vent opening remaining for passage of air between the skirt and wall portion, said vent opening forming a part of the air intake passageway for the pump, and means responsive to depression of said plunger for withdrawing a charge of said liquid from said container, the improvement which comprises:

flexible check valve means operatively disposed proximal to said vent opening for preventing outward flow of said liquid through said air intake passageway as a consequence of depression of said plunger and incident deformation of said flexible container, and for allowing flow of air through said vent opening as needed, said check valve means comprising an annular washer disposed about said plunger for abutting the underside of said skirt and slidably engaging the inner surface of said wall portion.

2. The pump as set forth in claim 1 including means mounting said washer for reciprocation with said head and plunger.

3. The pump as set forth in claim 1 wherein said washer has a Shore A durometer of up to about 90.

* * * * *